US005270617A

United States Patent [19]

Nonomura et al.

[11] Patent Number: 5,270,617

[45] Date of Patent: Dec. 14, 1993

[54] PLANAR TYPE DISPLAY DEVICE AND ITS DRIVING METHOD

[75] Inventors: Kinzo Nonomura, Ikoma; Kiyoshi Hamada, Sakai; Jumpei Hashiguchi, Neyagawa; Ryuichi Murai, Katano; Satoshi Kitao, Kyoto, all of Japan

[73] Assignee: Matsushita Electric Industrial Co., Ltd., Osaka, Japan

[21] Appl. No.: 833,445

[22] Filed: Feb. 7, 1992

[30] Foreign Application Priority Data

Feb. 8, 1991 [JP] Japan ..... 3-017529

[51] Int. Cl.[5] ..... H01J 29/02; H01J 29/50; G09G 1/04; G09G 1/20

[52] U.S. Cl. ..... 315/167; 315/169.1; 315/357; 315/366; 313/417; 313/422

[58] Field of Search ..... 315/366, 167, 169.1, 315/309, 357; 313/409, 411, 412, 414, 415, 417, 422, 438, 444, 459, 460, 146, 147, 151

[56] References Cited

U.S. PATENT DOCUMENTS 3,292,041 12/1966 Katagiri et al. ..... 315/357
4,651,049 3/1987 Saeki et al. ..... 313/355
4,708,678 11/1987 Tischer et al. ..... 445/24

*Primary Examiner*—David Mis
*Attorney, Agent, or Firm*—Wenderoth, Lind & Ponack

[57] ABSTRACT

In a planar type display device, deterioration of the picture quality caused by distortion of laminated electrodes due to temperature rise in use is prevented by laminating the electrodes having such a structure that each electrode plate is free from expansion and contract by thermal expansion. Securing means spacers 23 thicker slightly than electrode plates are inserted in holes of the electrode plates 21*a* to 21*e*, securing means pin 24 is passed therethrough holding electrode plate spacers 22 therebetween, forming laminated electrode group 5. Since the respective electrode plates have slight gaps in a thickness direction and the electrode plates are free from expansion and contraction and do not distorted at the time of thermal expansion.

16 Claims, 7 Drawing Sheets

PLANAR TYPE DISPLAY DEVICE AND ITS DRIVING METHOD

BACKGROUND OF THE INVENTION

1. Field of the Invention

The present invention relates to a planar type display device for use in a color television receiver or a terminal display of a computer and its driving method.

2. Description of the Prior Art

In an electrode structure in a conventional planar type display device, generally a group of laminated electrodes is constructed by bonding, pressure bonding or merely laminating them together. A proposal of a method of bonding the laminated electrodes has been already made by the same applicant in the Japanese patent laid open 102138/1988. This conventional electrode structure is shown in FIG. 1. The structure and the operation of this conventional proposal is briefly explained below.

In this electrode structure, there are provided a back electrode 101 with a plurality of shelves, filament cathodes 102 located between the shelves for generating electron beams, a vertical focussing electrode 103 for vertically focussing the electron beams, vertical deflection electrodes 104 for vertically deflecting the electron beams, electron beam control electrodes 105 for controlling the amount of the electron beams passing therethrough, a horizontal focussing electrode 106 for horizontally focussing the electron beams, horizontal deflection electrodes 107 for horizontally deflecting the electron beams, electron beam accelerating electrodes 108 and a screen 109 on which the electron beams impinge to display a picture in turn from the rear side to the front side. These components are accommodated in a container made of glass in the order of the above arrangement and the inside of the container is vacuumized. The electron beam generated by the filament cathode 102 is pushed forward by the back electrode 101. A signal modulation voltage which is obtained by converting an image signal into a pulse width modulation signal is applied to the respective electron beam control electrodes 105, whereby the amount of the electron beams passing therethrough is controlled. The screen 109 is coated with fluorescent members for emitting the light of three colors R (red), G (green) and B (blue). In this conventional example, the laminated electrode group consists of the vertical focussing electrode 103, vertical deflection electrodes 104, electron beam control electrodes 105, horizontal focussing electrode 106 and horizontal deflection electrodes 107. Also the vertical focussing electrode 103 and the horizontal focussing electrode 106 may be composed of a plurality of laminated electrode members.

The operation of this conventional example is explained below. A pulse voltage having a negative value is applied to one of the filament cathodes 102 so that an electron beam band is generated in the forward direction. The electron beam band is focussed in the vertical direction through the vertical focussing electrode 103. Thereafter, the vertically focussed electron beam is deflected in the vertical direction in 32 steps for example including an interlaced scan through the vertical deflection electrode 104. The amount of the electron beam to pas is controlled by the electron beam control electrode 105 in accordance with the image signal applied thereto. Thereafter, the electron beam is passed to the horizontal deflection electrode 107 through the horizontal focussing electrode 106, whereby the electron beam is horizontally deflected in six steps in a period of one horizontal scan. Each of the divided electron beams impinges on two pairs of fluorescent units for the three colors in turn of R - G - B to R - G - B, thereby emitting light for the three colors to display a picture band on the screen 109. This operation is sequentially repeated to display a series of picture bands thereby to display a complete picture.

This conventional device is intended to solve such a problem that, in a process of sintering for bonding the respective electrodes, when the electrodes are heated up to 450° C. which is the melting temperature of low melting frit glass, there occurs a temperature difference in the respective electrodes of the laminated electrode group, and therefore the electrodes can not be securely bonded with a high accuracy. The aim of this proposal is attained by keeping the temperature of the electrodes in a range of 330° C. to 370° C. for more than ten minutes, whereby the temperature difference can be decreased thereby to securely bond the electrodes with a high accuracy. The securely bonding condition of the laminated electrodes in the sintering process is shown in FIG. 2.

In this proposal, there was such a further problem that, since an interior of a panel is made vacuum in the intermediate step of subjecting to the thermal process, the atmospheric pressure is applied to the laminated electrodes, so that the electrodes are brought into their pressure bonding conditions with different thermal expansions respectively because the electrodes have different thermal expansion factors. Therefore, when the temperature of the electrodes is lowered to the room temperature, the friction forces generated in the electrodes are so large that each electrode can not recover the original formal location.

In order to solve this problem, a further proposal has been made by the same applicant in the Japanese patent laid open 124936/1989. This second proposal discloses a process of securely forming the laminated electrodes by pressure bonding. That is, after performing the thermal process, the circumference of the exterior of the panel is temporarily made vacuum, so that the pressure bonding condition of the laminated electrodes in the panel is temporarily released from the atmospheric pressure, thereby to recover the original locating condition of the electrodes with a high accuracy.

Moreover, a further proposal is made by the same applicant in the Japanese patent application 103801/1989, wherein the electrodes are slidably held when the electrodes are thermally expanded in the heating process. In this third conventional structure, the electrode plate has a warped portion therein and it is difficult that the whole plate becomes slidable, and that there often occur strong pressure bonding portions at the warped portions so as to expand the warped portions.

The three conventional examples of the prior art mentioned above are proposed for suppressing the decrement of the accuracy of locating the electrodes due to the different expansion factors thereof in the heating process of the laminated electrodes for securely forming a group of the laminated electrodes. Conventionally, it has been thought that the deterioration of the electrode accuracy is caused in the heating process for securely forming the electrodes. However, recently it has become apparent that the deterioration of the accuracy is caused not only by the heat in the above heating process but also by the effect of the heat generated by the filament cathodes arranged in the panel. Namely, it has become apparent that the major causes, which deteriorate the accuracy of locating the electrode so as to deteriorates the picture quality, are both the heat generated in the electrode forming process and the heat generated by the cathodes themselves while the panel is lighted on.

Moreover, it has become apparent that there is a further problem as mentioned below. After the panel is completed, when a number of filament cathodes are actually turned on, the temperature of the respective electrodes near to the filament cathodes rises considerably. On the other hand, the temperature of the electrodes in the distance away from the filament cathodes becomes lower. Therefore, there occurs thermal expansion differences among the electrodes, whereby the electrodes are partially expanded and contracted in a similar manner to those in the prior art as mentioned above. Consequently, there occur errors in the pitches and the like of holes of the electrodes through which electron beams pass, wherein the pitches of the electrodes are initially set in correspondence with the positioning of the respective parts of the fluorescent face, so that the electron beams can not be landed to the predetermined points on the fluorescent face, resulting in deterioration of the picture quality. On the other hand, while the panel is driven, the electron beams impinge on the light emitting means which is formed by coating the fluorescent member on a glass plate, and the temperature of the glass plate rises. At this time, since the thermal expansion of the laminated electrode group is different from that of the glass plate of the light emitting means, there occurs a further problem that the electron beams become unable to impinge on the predetermined points of the fluorescent face with time, although it does not become a problem for a small size panel but becomes a problem for a large size one.

SUMMARY OF THE INVENTION

An essential object of the present invention is, therefore, to provide a display device for displaying a picture with high quality, solving the problems mentioned above by correcting the errors due to the effects of the thermal expansion.

In order to accomplish the object, the display device of the present invention is provided with a group of laminated electrodes which are assembled by securing means, wherein at least a part of the laminated electrodes is so released with spaces as to be freely slidable in a plane direction thereof. That is, the released part of the laminated electrodes is not securely regulated but is freely slid in the plane direction thereof although the total thickness of the group of the laminated electrodes is fixed. The securing means has such a structure that the thickness thereof is not regulated by the total thickness of the laminated electrode group, thereby allowing the electron beams to impinge on the predetermined spots of the fluorescent face, avoiding the deterioration of the picture quality.

Moreover, the released part of the laminated electrodes is formed of an electrode member having a thermal expansion factor different from those of the other laminated electrodes which are securely fixed, wherein a control signal is applied to the released part of the laminated electrodes having the different thermal expansion factor, thereby controlling the electron beams passing through the laminated electrode group to impinge on the predetermined spots of the fluorescent face, preventing the deterioration of the picture quality.

Moreover, the securing means is constructed by the members for securing the uppermost portion and lowermost portion of the laminated electrode group for regulating the total thickness of the laminated electrode group, whereby at least the released part of the electrodes in the laminated electrode group can be freely expanded and contracted to be slid in the plane direction of the electrode maintaining a predetermined interval over its whole face, thereby obtaining a high picture quality with a good yield.

Moreover, since the securing means are situated in the outside of the display area in the display device so as to secure the laminated electrode group by fitting the securing means to the standard hole portion and the elongated standard hole portion defined in the released part of the laminated electrode group, so that the laminated electrode group can be located in a specified position with respect to the fluorescent face. Thus, it is possible to cause the electron beams to impinge on the predetermined spots of the fluorescent face, thereby obtaining a picture with high quality and with a good yield.

Moreover, since one end portion of the securing means facing to the display face plate is covered by an electrode member, therefore deterioration of the picture quality due to charging up or the like can be prevented.

Moreover, since the spacers for forming the securing means are formed by attaching insulation layers on the metal plates, the spacers of very low costs can be obtained with good accuracy, thereby obtaining a picture with a good yield and high quality.

Moreover, by forming the securing means by fitting engagement of the spacers in the intervals of the laminated electrodes or spacers for securing means, the number of components can be decreased and a picture with high quality can be obtained with a good yield.

The electrode structure of the planar type display device is generally constructed by a group of laminated electrodes. In the display device of the present invention, a group of laminated electrodes are constructed by securing means, wherein at least a part of the laminated electrodes is so laminated with spaces as to be freely slidable in a plane direction thereof. That is, the part of the laminated electrodes is not securely regulated but is released in the plane direction thereof although the total thickness of the group of the laminated electrodes is fixed. Thus, when the laminated electrode group is thermally expanded, the released part of the laminated electrodes is not regulated by the total thickness of the electrode group so as to be expanded or contracted and to be moved free from the effect of the friction.

The conventional slidable structure of the laminated electrode group is constructed in such a manner that the movement of the slidable electrode is regulated by the total thickness of the electrode group. If there is caused a bend of merely few tens micrometers in the electrode plate itself, the slidable electrode is moved with a considerable frictional force, so that uneven expansion and contraction is caused in the whole part of the slidable electrode, and partial bending and pitch differences are caused in the slidable electrode.

However, in the electrode structure of the present invention which is not regulated by the total thickness of the electrode group, the slidable electrode has a degree of freedom in the thickness direction thereof and the slidable electrode can be freely moved due to expansion or contract thereof without a frictional force with respect to the other electrodes or spacers. Thus, even when the slidable electrode is thermally expanded, the whole part of the slidable electrode can be evenly expanded and contracted, thereby preventing the occurrence of such a partial pitch difference in the slidable electrode.

Moreover, since at least a part of the laminated electrodes are formed of an electrode member having a thermal expansion factor different from that of the other laminated electrodes, therefore when a pitch difference is caused due to the difference between the thermal expansion of the part of the laminated electrodes and the thermal expansion of the glass plate of the light emitting means due to the heat generated in the process of forming the electrodes and to the heat generated by the filament cathodes when the panel is being lighted on, there occurs a difference or shift between the axis of the electron beam passing hole defined in the slidable electrode having the different thermal expansion factor and the axis of the electron beam passing holes of the other electrodes, so that both electrodes have a function of a deflection electrode. Therefore, by applying a new control signal to the laminated electrodes, it becomes possible to cause the electron beams to impinge on the predetermined points of the fluorescent face, thereby to correct the pitch difference of the slidable electrode.

Moreover, since the securing means are constructed by securing the uppermost and lowermost portions of the laminated electrode group so as to fix the total thickness of the laminated electrode group, therefore at least a part of the intermediate electrodes can be released to be freely expanded and contracted with a constant interval maintained over the whole face of the released electrode between the uppermost and lowermost electrodes, there does not occur any pitch difference, in addition the interval between the light emitting means to which a high voltage is applied and the uppermost laminated electrode can be kept even over the whole part of the laminated electrodes. Thus, it becomes easy to make the panel in which the electron beams can be impinged on the predetermined points of the fluorescent face, thereby obtaining a picture with high quality and a good yield.

Moreover, since the electrode securing means for securing the laminated electrode group is provided on the standard hole portion and in the elongated standard hole portion defined in at least a part of the laminated electrodes, the thermal expansion Occurs both sides of a standard line as the center line whose positional relation between the laminated electrode group and the fluorescent face is a single line, so that the pitch difference due to the expansion and contract by the thermal expansion can be maintained at a constant relation under optional temperature. Therefore, when the panels are manufactured, it is not necessary to take many data for adjusting every panel to avoid the pitch difference and the constant relation can be easily found, whereby it becomes possible to cause the electron beams to impinge on the predetermined points of the fluorescent face, thereby obtaining a picture with high quality with a good yield.

Moreover, since the securing portion of the securing means in the side of the display means is covered by the electrode member, the effect of the charge up can be fully eliminated, which occurs in the prior art because a part of the securing portion is made of insulation material. Thus, the deterioration of the picture quality can be prevented.

Moreover, since the spacers for the securing means are formed by attaching the insulation layer to the metal plate, the spacers slightly thicker than that of the electrode plate can be obtained by a method of blowing, electrical coating or printing, and extremely cheap and accurate spacers can be obtained. Thus, a laminated electrode group with high accuracy can be constructed with even spacers and a picture can be obtained with high quality with a good yield.

Moreover, by forming the securing means by fitting engagement of the spacers filled in the electrode interval or spacers for the securing means, the number of components can be remarkably decreased and a picture can be obtained with high quality with a good yield.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

A preferred embodiment of the present invention is explained with reference to the drawings.

Figure 1:
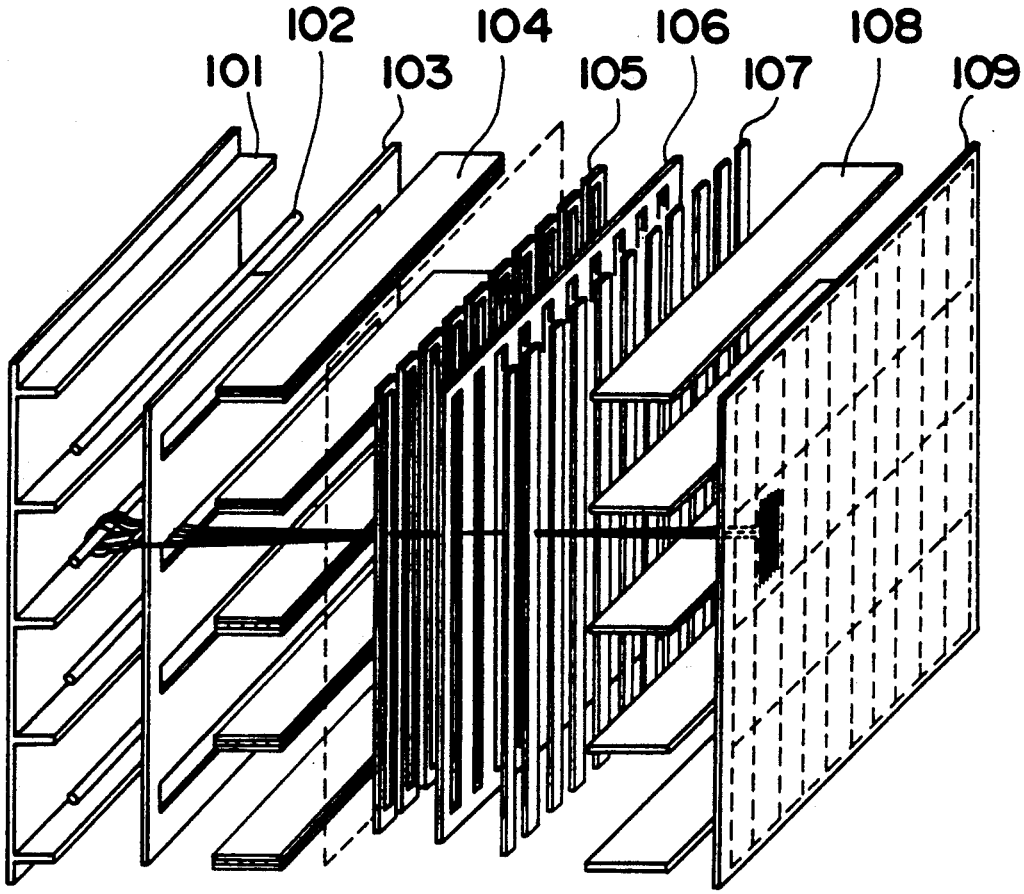
Fig. 1 (Prior Art)
FIG. 1 is a perspective view of an example of a prior art.
Figure 2:
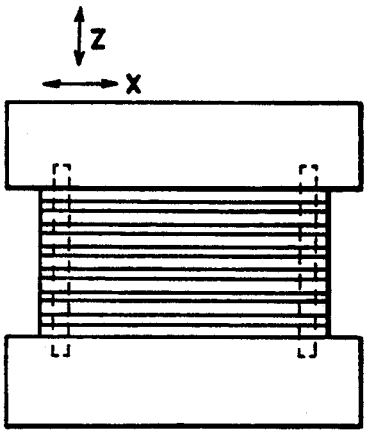
Fig. 2 (Prior Art)
FIG. 2 is a cross sectional view of a laminated electrode forming process in an example of a prior art.
Figure 3:
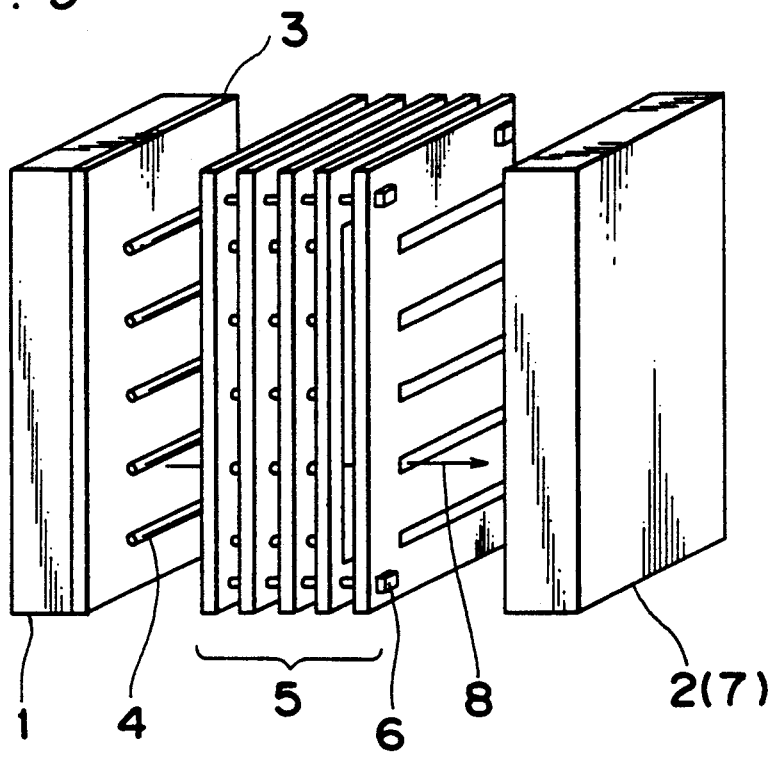
FIG. 3 is a perspective view of a basic electrode structure in one embodiment of the present invention.
Figure 4:
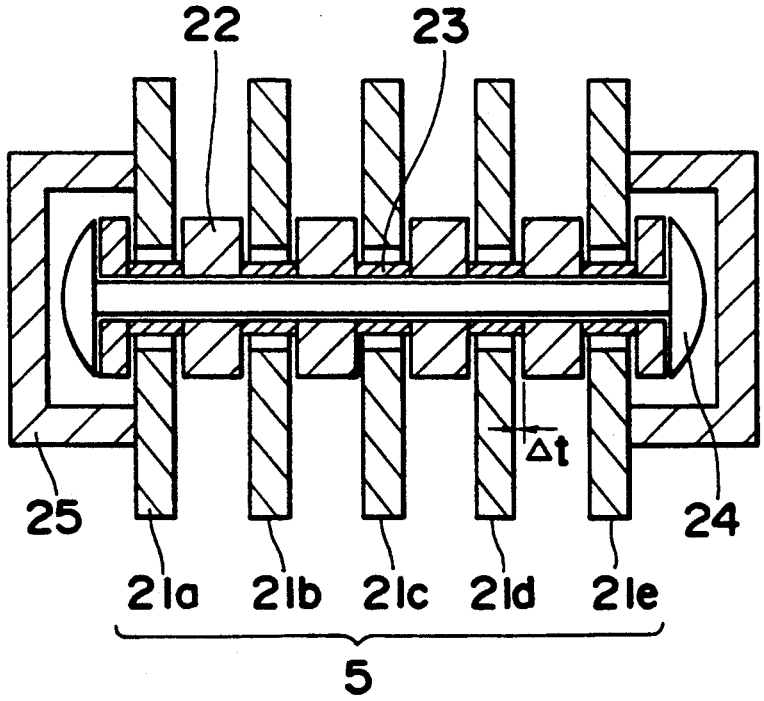
FIG. 4 is a cross sectional view showing securing means in one embodiment of the present invention.

FIG. 3 shows an essential portion of a basic structure of various electrodes including a group of laminated electrodes in a planar type display device according to the present invention. FIG. 4 shows a structure of a securing means for securing a group of the laminated electrodes. It is to be noted that, although the laminated electrode group 5 in this embodiment is arranged between electron sources 4 on a back electrode 3 and a fluorescent face 7 on a face plate 2, a planar type electron source on the back electrode 3 may be included in the laminated electrode group 5 in this embodiment. The basic structure of the various electrodes and the operating principle thereof are similar to the contents disclosed in the Japanese Patent laid open 173553/1989.

In a planar type display device shown in FIG. 3, the basic structure of the various electrodes is constructed in such a manner that a vacuum container for containing the various electrodes is formed of a back container plate 1 and face plate 2 which are made of glass plate of 10 to 15 mm thick, wherein the vacuum container is provided with the back electrode 3, filament cathodes 4 as electron sources, a group of laminated electrodes 5 and a light emitting means 7 having a fluorescent face formed on the face plate 2. The filament cathodes 4 are made of tungsten wires of 15 to 30 micrometers in diameter coated with oxide of such as Ba, Sr, or Ca. The laminated electrode group 5 is securely fixed with a high accuracy using a securing means 6 thereby to control the electron beam 8 generated by the filament cathodes 4 by focussing, modulating and deflecting the electron beam 8. The size of the face plate panel is 8 to 18 inches and a picture displayed on the face plate panel is about 6 to 16 inches.

The principle of the operation of the planar type display device is mentioned below. The electron beams 8 are sequentially generated from a plurality of filament cathodes 4 extended in parallel at regular intervals, thereafter each of the electron beams 8 is divided into a plurality of electron beams through the laminated electrode group 5. The quantity of the electron beams 8 is controlled by modulating the electron beams through a modulation electrode in response to picture signals. The modulated electron beams are simultaneously deflected in the horizontal direction through horizontal deflection electrodes by applying stepped deflection voltages of several steps to the horizontal deflection electrodes. Thereafter, the horizontally deflected electron beams are deflected in the vertical direction through vertical deflection electrodes by applying stepped deflection voltages to the vertical deflection electrodes. Thereafter, each of the electron beams impinges on the fluorescent face of the light emitting means, thereby causing the emission of light to display a picture on the display panel.

In this embodiment, as shown in FIG. 4, the laminated electrode group 5 consists of five laminated electrodes, each made of thin metal sheet of 0.2 mm thick, which are G1 electrode 21*a* for taking out the electron beams, G2 electrode 21*b* for modulating the electron beams, G3 electrode 21*c* for focussing the electron beams or for other operations, G4 electrode 21*d* for deflecting the electron beams in the horizontal direction and G5 electrode 21*e* for deflecting the electron beams in the vertical direction.

Means for securing the laminated electrodes 21*a* to 21*e* is comprised of electrode interposed spacers 22, securing spacers 23 and a securing pin 24. The laminated electrodes 21*a* to 21*e* are respectively juxtaposed at the positions of the securing spacers 23 disposed between the electrode interposed spacers 22. The thickness of each of the laminated electrodes 21*a* to 21*e* is thinner by $2\Delta t$ than the thickness of each of the securing spacers 23 as shown in FIG. 4. Specifically, the thickness of the securing spacer 23 is about 210 to 220 micrometers and the thickness of each of the laminated electrodes is about 200 micrometers. In this case, there is a gap of about 10 to 20 micrometers in thickness therebetween by the calculation. However, since there are differences of about several micrometers in thickness in each of the actual laminated electrodes, therefore the actual gap is smaller than the above value. Nevertheless, the laminated electrodes 21*a* to 21*e* can be slid freely in the plane direction thereof due to the small actual gap between each of the laminated electrodes and each of the electrode interposed spacers 22. Even such a small gap between the electrodes causes a displacement of the electrode in the thickness direction thereof, which affects the change of such as focusing and deflection of the electron beams. According to a permissible range of the change of the focusing shape of the electron beams on the screen and the displacement of the impinging position of the electron beams from the viewpoint of picture quality, the displacement of the electrode in the thickness direction must be set smaller than 50 micrometers. Therefore, the size of the gap may be set in the range of 1 to 50 micrometers, whereby the electrode can be independently expanded and contracted.

That is, the total thickness of the laminated electrode group 5 is defined not by the thickness of the laminated electrodes themselves but by the thickness of the electrode interposed spacers 22 and the securing spacers 23. Namely, at least a part of the laminated electrodes is released to be freely slidable in the plane direction thereof, wherein the released part of the laminated electrodes is not securely regulated by the securing means but is freely slidable in the plane direction thereof although the total thickness of the group of the laminated electrodes is fixed.

Thus, when the laminated electrode group is thermally expanded, the released part of the laminated electrodes is not regulated by the total thickness of the electrode group so as to be freely expanded or contracted and to be moved free from the effect of the friction force applied by the spacers 22 and 23.

Figure 9A:
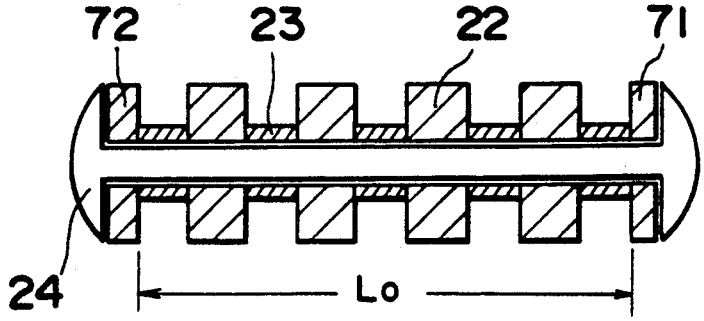
Figure 9B:
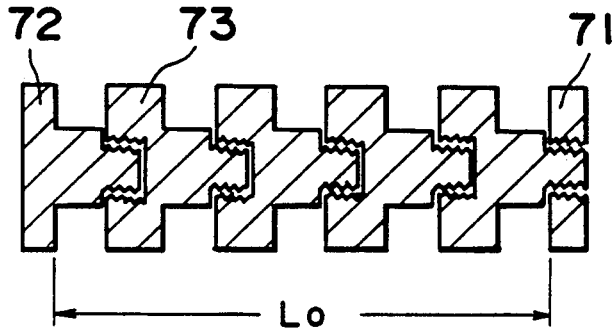

When all of the laminated electrodes of the laminated electrode group are constructed as mentioned above, the total thickness of the laminated electrode group 5 is actually defined by the total thickness $L_O$ of the electrode interposed spacers 22 and the securing spacers 23. As a means for fixing the total thickness of the laminated electrode group 5, a securing pin 24 is inserted through the electrode interposed spacers 22 and securing spacers 23, and the both end portions of the securing pin 24 are welded to the uppermost and lowermost portions 71 and 72 of the electrode interposed spacers 22 as shown in FIG. 9(*a*). As a method of securing the securing pin 24, there may be used a threading method, spring securing method or welding method. In this embodiment as shown in FIG. 4, the securing pin 24 is fabricated by a metal pin of 0.7 mm diameter with its both end portions secured by welding.

By forming the electrode interposed spacers 22 and securing spacers 23 using ring shape members of ceramics, they can be easily assembled independently of the setting direction at the time of assembling. In the etching process for forming the laminated electrodes, the ring shaped securing components for the spacers 23 are previously formed by patterning in the respective portions corresponding to the places where the securing means are to be disposed, thereby facilitating to form the components to be used as the securing spacers with a high accuracy. Thus, the components for the securing spacers 23 are coated by blowing with frit glass by approximately 5 to 10 micrometers in thickness as the insulation layer thereof and in turn the components coated with frit glass are sintered at a temperature of approximately 450° C., whereby the securing spacers 23 can be formed. In this example, the insulation layer of the frit glass of 1 to 50 micrometers thick may be utilized.

As other production methods of forming the securing means, there may be employed a suitable method such as an electrodeposition coating method, plasma injection method, or evaporation method.

Also, the electrode interposed spacers 22 can be formed using a metal material in a manner similar to that of forming the securing spacers 23, and thereafter the insulation layers are coated thereon.

Moreover, the securing pin 24 has its diameter of about 0.3 to 2.0 mm depending on the size of the panel and as the material thereof, ceramics or metal can be used.

Figure 10A:
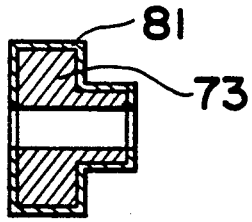
Figure 10B:
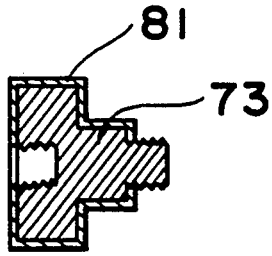

The securing means can be constructed using spacer components combining the electrode interposed spacers with the securing spacers integrated into one body. As shown in FIG. 10(*a*), a hollow member like a nut used for screw fastening but having a stepped shape is previously made using metal, in turn the outer face thereof is coated with an insulation layer 81 of such as alumina or frit glass by evaporation or electrodeposition coating, thereby obtaining a spacer component 73 combining the electrode interposed spacer with the securing spacer integrated as one body.

Moreover, the securing means may be constructed by screw threading or engagement of the electrode interposed spacers, securing spacers with the components for the spacers without using a securing pin.

As shown in FIG. 10(*b*), a threading engagement type spacer component 73 can be formed in such a manner that on a three stepped metal bar, a male screw is formed at its one leading end portion with its other end formed as a female screw, wherein the outer whole faces of the three stepped metal bar is coated with an insulation layer 81 made of alumina or frit glass by an evaporation or electrodeposition coating.

FIG. 9(*b*) shows a securing means assembled by screw engagement of the threading type spacer components 73. In this case, the both end portions of the securing means define the uppermost portion 71 and the lowermost portion 72, fixing the total thickness Lo of the securing means. In place of threading engagement, it is also possible to form the leading head of each spacer component 73 in a cylindrical shapes to be engaged with each other by pressure fitting insertion thereof.

Referring back to FIG. 9(*a*), the laminated electrode group 5 constructed by the securing means as mentioned above is arranged in the vacuum container together with the electron sources of cathodes 4 and the light emitting means of the fluorescent face 2, and when the electrode system in the container is operated, in a case where the head portion of the securing pin 24 is covered by an insulation material, electric charges are charged up on the insulation material by the electron beams or the like. Consequently, the potential condition becomes unstable to disturb the electric fields in the surroundings, resulting in that the projecting positions of the electron beams can not be controlled accurately thereby to deteriorate the quality of a picture to be displayed.

Moreover, in a case where the head portion of the securing pin 24 is made of metal, when the securing pin 24 is disposed in a position away from the display area, there is scarce effect on the electron beams running from the laminated electrode group to the light emitting means but in a case where the securing pin 24 is disposed within the display area or its neighborhood, the head portion of the pin 24 projects, whereby the electric field of its neighborhood is different from that of the area where the pin is not situated, and the electron beams can not be accurately controlled, resulting in deterioration of the picture quality.

In order to prevent these defaults, in a case where the securing pin is made of insulation material, the outer surface of the securing pin 24 is coated with a conductive layer, otherwise covering means 25 are formed for covering both end portions of the securing pin 24 as shown in FIG. 4, thereby preventing the deterioration of the picture quality.

Figure 11A:
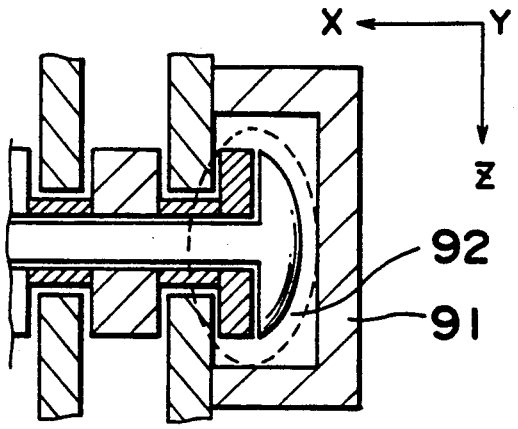
Figure 11B:
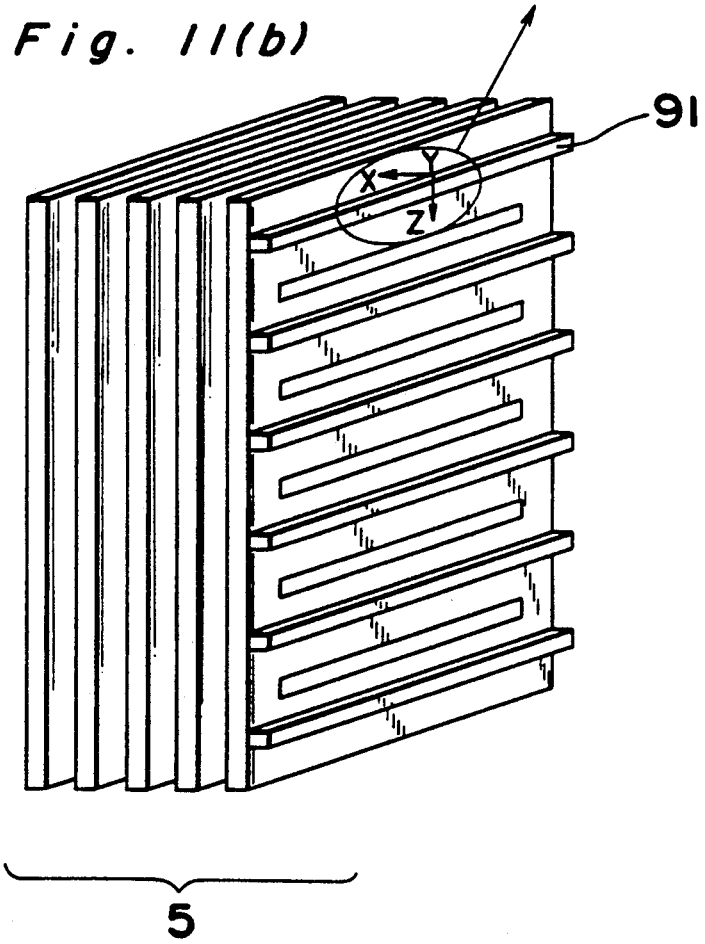

Moreover, in a case where the pin 24 is disposed within the display area or in the neighborhood thereof, one side of the covering means 25 facing to the fluorescent face 2 is formed of an electrode member 91 as shown in FIGS. 11(*a*) and 11(*b*), whereby voltages for focusing and deflecting the electron beams are applied to the electrode member 91 thereby to prevent the deterioration of the picture quality.

Specifically, the conductive layer for coating the securing pin made of insulation material can be deposited on the outer surface of the pin by evaporating or electrodeposit-ting such as Al, Ag, Ni or Au material.

The covering means 25 can be formed by etching the metal plate of 0.2 mm thick which is the same as that of the laminated electrode. At the time of etching the metal plate for forming the covering means 25, by performing a half etching of the portions corresponding to the bending lines of the covering means 25, the covering means 25 can be easily bent with a high accuracy. In this way, the covering means 25 can be formed by an electrode member made of an elongated metal of 1 mm×3 mm of generally U character shape in a cross section with about 10 to 30 cm long, and the covering means 25 are secured to the uppermost portion of the laminated electrode by welding a partial portion thereof to the laminated electrode for covering the both ends of the securing pin 24.

In a case where the size of the display panel is 10 inches, in the display area of 150 mm in the vertical direction and 200 mm in the horizontal direction, there are disposed respective fluorescent members of three colors of R(red), G(green) and B(blue) with vertical stripes with 0.167 mm pitches in the horizontal direction thereof. When the laminated electrode group is secured in the panel container, it is difficult to secure the laminated electrode group only by lead terminals taken out from the peripherals of the panel container due to the bending of the laminated electrode group by the self weight thereof. Therefore, three securing means are provided for securing the electrodes at the upper and lower portions respectively in the longer side direction outside the display area more than 10 mm away from the edges of the display area, thereby preventing the laminated electrode group from bending.

Figure 8:
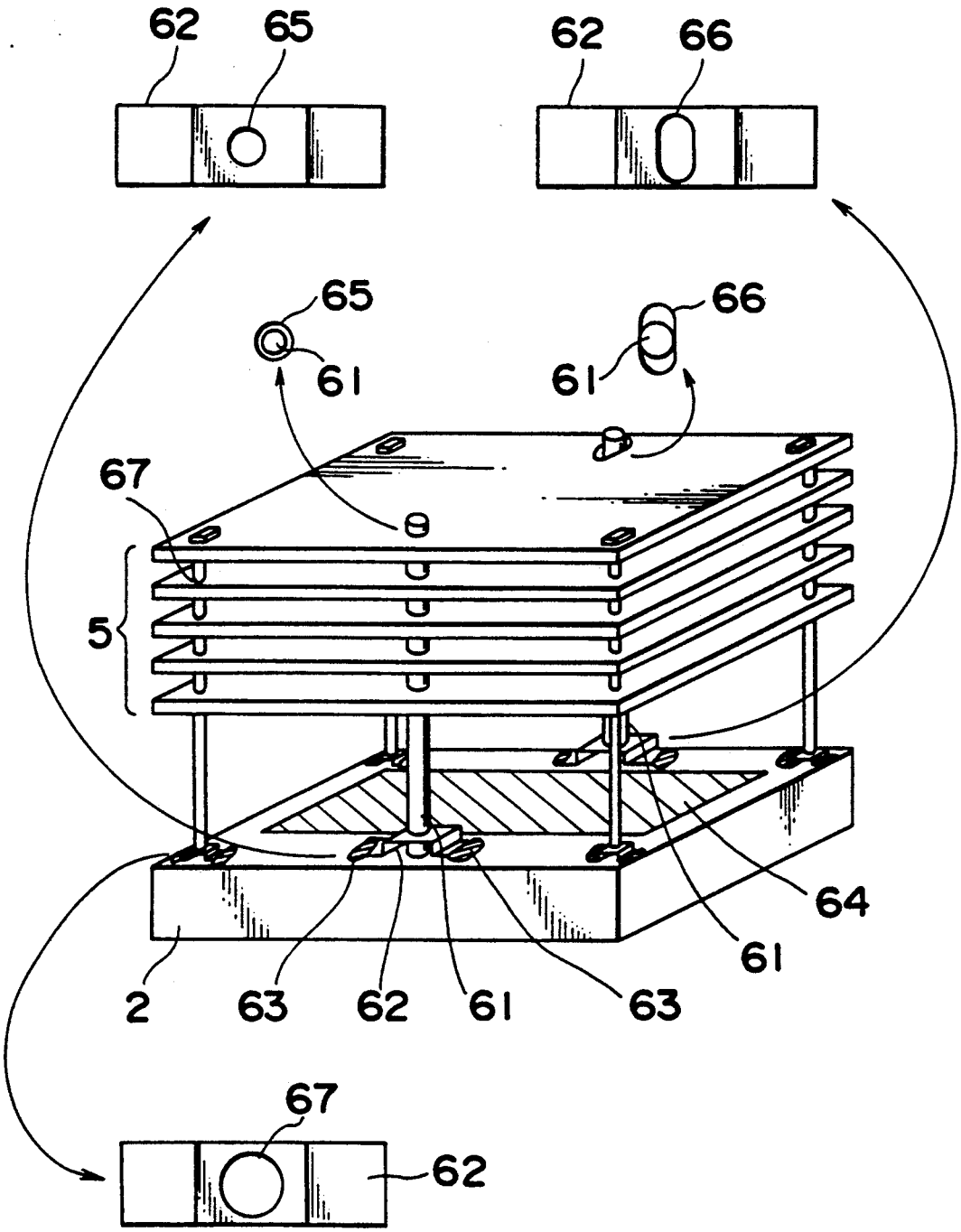
FIGS. 8 is a perspective view showing a partial electrode structure including the electrode securing means in one embodiment of the present invention, FIG. 9(*a*) is a across sectional view showing the securing means of one embodiment of the present invention, FIG. 9(*b*) is a cross sectional view showing another securing means, FIGS. 10(*a*) and 10(*b*) are cross sectional views respectively showing partial components of other securing means, and FIGS. 11(*a*) and 11(*b*) are a partial cross sectional view and a perspective view respectively each showing a securing part covering portion in the display side of the securing means.

Specifically, as shown in FIG. 8, in the respective laminated electrodes, there are defined standard holes 65 of 1 mm diameter, elongated standard holes 66 of 1 mm wide×2 mm long at both upper and lower portions of the central points in the longer side direction by 13 mm outside from the edge of the display area 64, and there are defined through holes 67 of 2 mm diameter at both left and right points in the upper and lower portions in the longer side direction by etching when the electrodes are etched. Pins 61 of 0.85 to 0.95 mm diameter are inserted into the respective holes 65, 66 and 67. The pins 61 are tightly inserted in the standard holes 65 and the elongated standard holes 66 defined in the upper and lower portions at the centers in the longer side direction so that each laminated electrode can be expanded and contracted in the shorter side direction making the standard hole as a center, and each laminated electrode is expandable and contractile in the longer side direction making the line connecting the standard hole 65 and the elongated standard hole 66 as a center line thereof.

Accordingly, in the temperature rising condition in the processes for forming the panel or in the period where the panel is being lighted on, there does not occur such irregular inreproducable displacement in the laminated electrodes with respect to the stripe fluorescent members. Moreover, the basic structure of the securing means shown in FIG. 8 consisting of the pins 61, standard holes 65, elongated standard holes 66 and through holes 67 is as the same as that of the securing means shown in FIG. 4 but is greatly different from in the point that the pins 61 are securely fixed to the face plate 2 in the example shown in FIG. 8, while the pin 24 is not secured to the face plate 2 in the example shown in FIG. 4.

In order to secure each of the pins 61 to the face plate 2, at the respective positions on the face plate 2, there are provided base plates 62 by sintering with frits, each base plate 62 having a generally U character shape with the standard hole 65 or elongated standard hole 66 defined in the center portion thereof or with the through hole 67, whereby the pin 61 is elected thereon and the laminated electrode group can be securely positioned. In this case, the pins 61 are made of ceramics. The pins 61 may be made of metal, but in this case, the pins 61 must be insulated from the voltages applied to the electrodes and from a high voltage applied to the fluorescent face, therefore it is required to use an insulation pipe for shield or to form an insulation layer covering the metallic pins 61.

Figure 5:
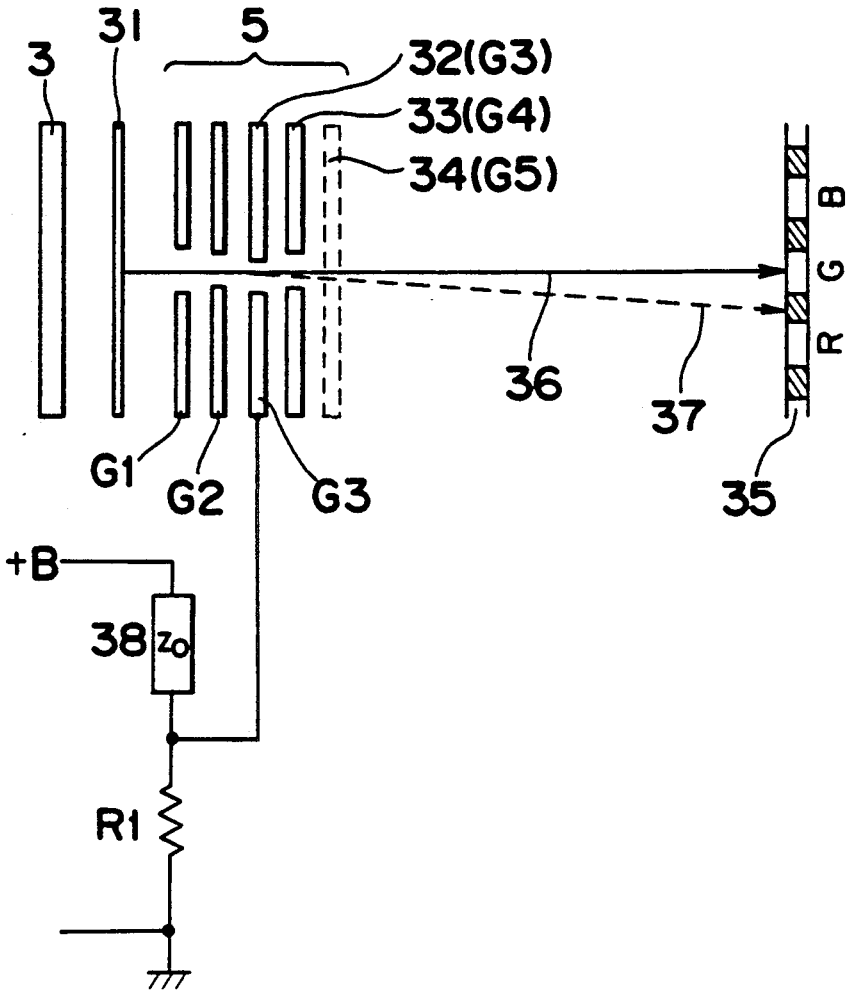
FIG. 5 is a schematic diagram for explaining a control of electron beams performed by applying a control signal to the electrode having a different thermal expansion factor.

At least a part of the laminated electrodes 5 are formed of an electrode member having a thermal expansion factor different from that of the other laminated electrodes. A control circuit is connected to the part of the laminated electrodes having the different thermal expansion factor for applying control signals to the electrode. A specific example thereof is explained with reference to FIGS. 5 and 8. The G1 electrode, G2 electrode, G4 horizontal deflection electrode 33 for deflecting electron beams in the horizontal direction and G5 vertical deflection electrode 34 for deflecting electron beams in the vertical direction are respectively made of SUS 304 material of 0.2 mm thick, and the G3 electrode is made of 42-6 alloy of 0.2 mm thick. In the drawing of FIG. 5, the vertical deflection electrode 34 is shown by dotted lines because the cross sectioned portion thereof corresponds to a slit of an elongated hole. The fluorescent face 35 is formed of assembly of units each consisting of a fluorescent member for the three colors R, G and B and a black stripe guard band made of carbon which are coated on the face plate 2 in a stripe manner with a pitch of approximately 167 micrometers.

When the panel is lighted on, the temperature inside the panel rises by the thermal radiation from the cathodes 31 disposed with pitches of several millimeters, and therefore, the respective laminated electrodes 5 thermally expand, making the standard hole 65 as a center including around the elongated standard hole 66 and the through hole 67 as shown in FIG. 8. When the G3 electrode 32 is made of 42-6 alloy and the G1, G2, G4 and G5 electrodes are made of SUS 304, since the thermal expansion factors of the 42-6 alloy and SUS 304 are respectively 85 to $92\times10^{-7}$/°C. and $173\times10^{-7}$/°C., when the temperatures of the electrodes G1 to G5 respectively rises by 100°, 95°, 90°, 85° and 80° C., in the slit holes defined in the respective electrodes G1 to G5 for the electron beams to pass through positioned apart from the standard hole 65 about 10 mm, there are caused displacements of 173, 164, 81, 147 and 144 micrometers from the original positions thereof.

In this case, without application of the control signal to the G3 electrode, the locus of the electron beam to be projected to the fluorescent unit G for example is deflected to impinge on the guard band as the electron beam 37 represented by a dotted line as shown in FIG. 5 due to its different thermal expansion factor, resulting in deteriorating the picture quality such as dropping the brightness of the displayed picture. However, since the displacement of the G3 electrode is in such a large range of 60 to 90 micrometers compared to those of other electrodes, the direction of the electron beam can be controlled from the locus 37 to the locus 36 by applying the control signal of about 10 to 100 volts to the G3 electrode. When the control of the electron beam is performed, the locus of the electron beam becomes as the electron beam 36 shown by a real line, thereby allowing the electron beam to impinge on the fluorescent unit G accurately. On the other hand, the temperature of the fluorescent face on the glass face plate rises approximately 10° C. to 20° C. similarly to the glass plate. Therefore, the size of the fluorescent face expands about 10 to 20 micrometers. Accordingly, by appropriately choosing the electrode material having a predetermined thermal expansion factor and voltages to be applied to the respective electrodes suitably, even if the fluorescent face expands a bit, corresponding to the expansion, it is always possible to specify the impinging point of the electron beam with a high accuracy. Actually, by the electrode construction using the electrode material as mentioned above, the electron beam can impinge on the specified region in the fluorescent face with an accuracy in a range of 10 micrometers and the picture quality was scarcely deteriorated.

As shown in FIG. 5, the circuit arrangement for applying the control signal includes a voltage source for applying a necessary voltage +B and a dividing circuit divided by a load Zo which changes with time and a resister R1, and the G3 electrode is connected to the divided position between the load Zo and the resister R1 and the resister R1 is connected to the ground. The load Zo changes with the time change corresponding to the temperature change of the panel, so that the divided voltage also changes, whereby the control signal with the change of the divided voltage is applied to the G3 electrode.

Figure 6:
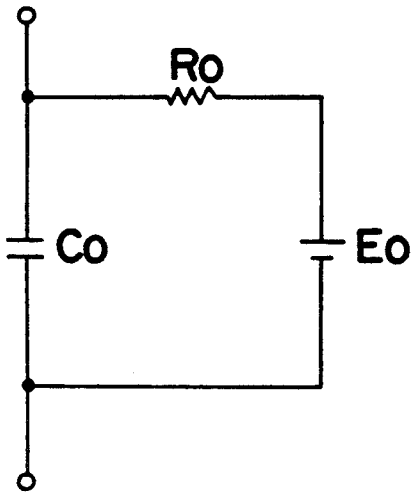
FIG. 6 is a circuit diagram showing a basic control unit for use in an embodiment of the present invention.

FIG. 6 shows the basic circuit structure of the load Zo which changes with the time change. The circuit of the load Zo is a kind of CR time constant circuit in which, for example, the value of Co is set to 360 microfarad, and the resistance Ro is set to 10 MΩ, and the voltage Eo is set to 200 V, thereby controlling the G3 electrode slowly nearly one hour. In order to control the G3 electrode with a high accuracy, such a circuit device is commercially sold as a programmable controller using a microcomputer. In this example, it is not necessary to form the panel with such a high accuracy. If the pitch of the fluorescent unit is as large as 330 micrometers, it is not necessary to connect the control circuit so long as the thermal expansion factor of only the G3 electrode is different from those of the other electrodes. To the contrary, by using another electrode other than the G3 electrode having different thermal expansion factor, it is possible to control the impinging point of the electron beam without using such a control circuit.

Figure 7:
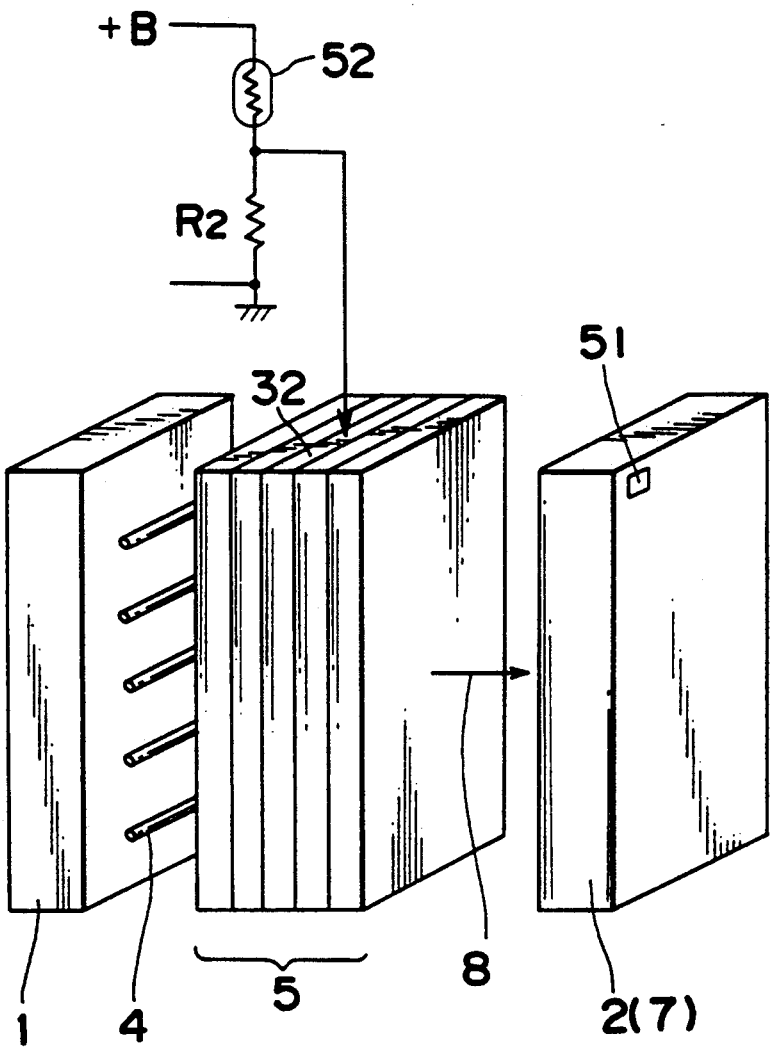
FIG. 7 is a schematic diagram for explaining the control system for controlling the electron beams corresponding to the temperature change of the panel.

Moreover, in order to display a picture with higher quality and accuracy, it is necessary to make the pitch of the fluorescent units for the respective three colors R, G and B smaller with enhancement of the accuracy of the impinging point of the electron beam. In other words, it is also necessary to make the change of the focusing spot of the electron beams as small as possible. On the other hand, due to the difference of the temperature rise of the respective electrodes and to the non-linearity of the thermal expansion factor of the material of the electrodes with respect to the temperature thereof, the relation between the thermal expansion difference of each electrode and the temperature thereof is not linear if observed precisely. Therefore, it is necessary to change the voltage applied to the electrodes according to the temperature rise. In the basic structure of the electrode system mentioned above, when the pitch of the fluorescent units for the three colors R, G and B of the fluorescent face is decreased to a size of about 100 micrometers from a size of about 167 micrometers, the picture quality is deteriorated. Therefore, by changing the voltage applied to the G3 electrode in a range from several volts to several tens volts according to the temperature rise inside the panel, the impinging position of the electron beam can be specified with a high accuracy in a range of several micrometers and the picture quality was scarcely deteriorated. example is shown in FIG. 7, wherein in order to be applicable to the circumferential temperature, another control signal is applied to the electrode having the different thermal expansion factor in accordance with the temperature change of the panel, whereby the electron beams can be controlled more accurately. There are provided a temperature detector 51 on the outer face of the face plate 2, and for example, a thermistor 52 so that the temperature in a range of −20° C. to 80° C. can be detected as the change of the resistance value. The thermistor is serially connected to a resister R2 so that the source voltage +B is divided to be applied to the G3 electrode 32, whereby it is possible to control the electron beam 8 to impinge on the specified position of the fluorescent face 2 in a similar manner as mentioned above. The electrode structure in this example comprises the back electrode 1, light emitting means 7 formed on the face plate 2, electron source 4 disposed on the inner surface of the back electrode 1 and the laminated electrode group 5.

As clearly described above, the display device of the present invention is provided with a group of laminated electrodes which are laminated with a distance apart from each other and assembled by securing means, wherein at least a part of the laminated electrodes is so released with spaces as to be freely slidable in a plane direction thereof. That is, the specified part of the laminated electrodes is not securely regulated but is released in the plane direction thereof although the total thickness of the group of the laminated electrodes is fixed. The securing means has such a structure that the thickness thereof is not regulated by the total thickness of the laminated electrode group, thereby allowing the electron beams to impinge on the predetermined spots of the fluorescent face, avoiding the deterioration of the picture quality.

Moreover, the released part of the laminated electrodes is formed of an electrode member having a thermal expansion factor different from that of the other laminated electrodes which are securely fixed, wherein a control signal is applied to the released part of the laminated electrodes having the different thermal expansion factor, thereby controlling the electron beams passing through the laminated electrode group to impinge on the predetermined spots of the fluorescent face, preventing the deterioration of the picture quality.

Moreover, the securing means is constructed by the members for securing the uppermost portion and lowermost portion of the laminated electrode group so as to regulate the total thickness of the laminated electrode group, whereby at least the released part of the laminated electrodes in the laminated electrode group can be freely expanded and contracted to be slid in the plane direction thereof maintaining a predetermined space over its whole face, thereby obtaining a high picture quality with a good yield.

Moreover, since the securing means are situated in the outside of the display area in the display device for securing the laminated electrode group fitted to the standard hole portion and the elongated standard hole portion defined in the released part of the laminated electrode group, therefore the laminated electrode group can be located in a specified position with respect to the fluorescent face. Thus, it is possible to cause the electron beams to impinge on the predetermined spots of the fluorescent face, thereby obtaining a picture with high quality and with a good yield.

Moreover, since one end portion of each securing means facing to the display plate is covered by an electrode member, therefore deterioration of the picture quality due to charging up or the like can be prevented.

Moreover, since the spacers for forming the securing means are formed by attaching the insulation layers on the metal plates, the spacers of very low costs can be obtained with a high accuracy, thereby obtaining a picture with a good yield and high quality.

Moreover, by forming the securing means by fitting engagement of the spacers in the intervals of the laminated electrodes or spacers for securing means, the number of components can be decreased and a picture with high quality can be obtained with a good yield.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A planar type display device comprising:

electron control means for controlling at least the focus of the electron beams extracted by said electron generating means, said electron control means being constructed by laminating a plurality of electrodes with a distance apart from each other by filling spacers between the respective laminated electrodes;

light emitting means having a fluorescent face for emitting light to display a picture when the electron beams impinge thereon; and securing means for securely assembling said plurality of laminated electrodes with the spacers, wherein at least one electrode of said plurality of laminated electrodes is released from the spacers so as to be freely slidable in a plane direction thereof, wherein the total thickness of said plurality of laminated electrodes is fixed, while the thickness of said securing means is not regulated by the total thickness of the laminated electrode group, thereby allowing the electron beams to impinge on the predetermined spots of the fluorescent face.

2. The planar type display device according to claim 1, wherein said at least one electrode of the plurality of laminated electrodes has its thermal expansion factor different from those of the other laminated electrodes.

3. The planar type display device according to claim 1, wherein said laminated electrode group secured by said securing means situated in the outside of a display area of the display device.

4. The planar type display device according to claim 1, wherein said securing means includes means for fixing the distance between the uppermost portion and the lowermost portion of said laminated electrode group.

5. The planar type display device according to claim 1, wherein said securing means is formed by laminating electrode interposed spacers and securing spacers and wherein at least a part of said securing spacers is made thicker than each of the laminated electrodes.

6. The planar type display device according to claim 3, wherein said securing means for securing the laminated electrode group are formed in a standard hole and an elongated standard hole which are defined in said at least one electrode of the laminated electrode group.

7. The planar type display device according to claim 6, wherein said standard hole and said elongated standard hole are defined in the intermediate portions in the longer sides of said at least one electrode.

8. The planar type display device according to claim 1, wherein one end portion of said securing means facing to the fluorescent face is covered by an electrode member.

9. The planar type display device according to claim 5, wherein said securing spacers are formed by attaching an insulating layer to a metal plate having the same thickness as that of the laminated electrode.

10. The planar type display device according to claim 5, wherein said securing means is fabricated using a pin, ring shaped electrode interposed spacers and ring shaped securing spacers.

11. The planar type display device according to claim 1, wherein said securing means is fabricated using a spacer component which is formed by integrally combining the electrode interposed spacers and the securing spacers.

12. The planar type display device according to claim 5, wherein said securing means is fabricated by fitting engagement of the electrode interposed spacers and the securing spacers.

13. The planar type display device according to claim 5, wherein said securing means is fabricated by threading engagement of the electrode interposed spacers and the securing spacers.

14. The planar type display device according to claim 5, wherein said electrode interposed spacers and said securing spacers are formed by attaching insulation layers to metal plate.

15. A method of driving the planar type display device as claimed in claim 2, wherein the electron beam passing through the laminated electrode group is controlled by applying a control signal to said at least one electrode having the different thermal expansion factor, whereby the electron beam impinges on a specified spot on the fluorescent face.

16. The method of driving the planar type display device according to claim 15, the control signal applied to the electrode having the different thermal expansion factor is varied in accordance with the change of the temperature of the planar type display device.

* * * * *